US005875749A

United States Patent [19]

Bentel et al.

[11] Patent Number: 5,875,749

[45] Date of Patent: Mar. 2, 1999

[54] A.C. IGNITION SYSTEM FOR AN ENGINE

[75] Inventors: Ulrich Bentel, Wiernsheim; Helmut Schmied, Marbach; Thomas Capouschek, Münchingen, all of Germany

[73] Assignee: Robert Bosch GmbH, Stuttgart, Germany

[21] Appl. No.: 963,719

[22] Filed: Nov. 4, 1997

[30] Foreign Application Priority Data

Nov. 21, 1996 [DE] Germany ..... 196 48 144.9

[51] Int. Cl.[6] ..... F02P 3/04

[52] U.S. Cl. ..... 123/651; 315/209 T

[58] Field of Search ..... 123/606, 644, 123/651, 652; 315/209 T

[56] References Cited

U.S. PATENT DOCUMENTS 3,949,722 4/1976 Linstedt et al. ..... 123/651

4,359,038 11/1982 Xiberas ..... 123/651 X 5,603,308 2/1997 Ooyabu et al. ..... 123/644

*Primary Examiner*—Tony M. Argenbright

*Attorney, Agent, or Firm*—Kenyon & Kenyon

[57] ABSTRACT

An a.c. ignition system for an engine, with an ignition transistor that switches the primary winding of an ignition coil, with a control circuit for controlling the ignition transistor and a parallel circuit including a capacitor and a diode between the emitter and collector of the ignition transistor. The control circuit can receive a measuring signal that is proportional to the collector potential of the ignition transistor, and the control circuit controls the ignition transistor depending on the measuring signal so that the ignition transistor is activated at a low voltage between the collector and emitter of the transistor.

12 Claims, 3 Drawing Sheets

A.C. IGNITION SYSTEM FOR AN ENGINE

FIELD OF THE INVENTION

The present invention relates to an a.c. ignition system for an engine, with an ignition transistor that switches a primary winding of an ignition coil, with a control circuit for controlling the ignition transistor, and with a parallel circuit of a capacitor and diode between the emitter and collector of the ignition transistor.

BACKGROUND INFORMATION

An a.c. ignition system is known from the related art, e.g., in the form of the circuit illustrated in FIG. 3. An ignition transistor designed as an IGBT (insulated gate bipolar transistor) is driven by a control circuit A. In addition to an operational amplifier (difference amplifier), a current detecting device and a driver circuit (referred to below simply as a driver), this control circuit includes a timing element whose output signal is sent to the difference amplifier after being AND-ed with an ignition control signal. The mode of operation of this circuit is based on the fact that the ignition transistor is switched off when the voltage drop at a shunt resistor exceeds a certain value. The ignition transistor is then activated again after a certain period of time defined by the timing element. Using a timing element should achieve the result that the starting operation of the ignition transistor falls in a certain time window in which a diode arranged between the collector and emitter of the ignition transistor is active. In this case, the activation operation has practically no effect on the properties of the circuit.

However, this yields the disadvantage that the time window can shift due to tolerance or aging of the ignition coil and spark plug, i.e., the time-critical components, due to a different oscillation characteristics of the circuit in secondary idling and during sparking. If the control signal of the ignition transistor no longer falls in the active phase of diode D, so there are starting current peaks with each switching operation, the total power loss of the circuit is increased, and the available igniting voltage is also reduced.

SUMMARY OF THE INVENTION

The a.c. ignition system according to the present invention has the advantage over the related art that the ignition transistor is always activated at the start of the above-mentioned time window. The control of the ignition transistor is thus adapted to the local conditions, so that tolerances or age-related changes have no effect on switching performance. This is accomplished by the fact that the control circuit receives a signal proportional to the collector potential of the ignition transistor and the control is based on this signal. In addition, the ignition transistor is switched "softly" with the first energization in each ignition period, which also has positive effects on the functionality of the ignition system.

DETAILED DESCRIPTION

Figure 1:
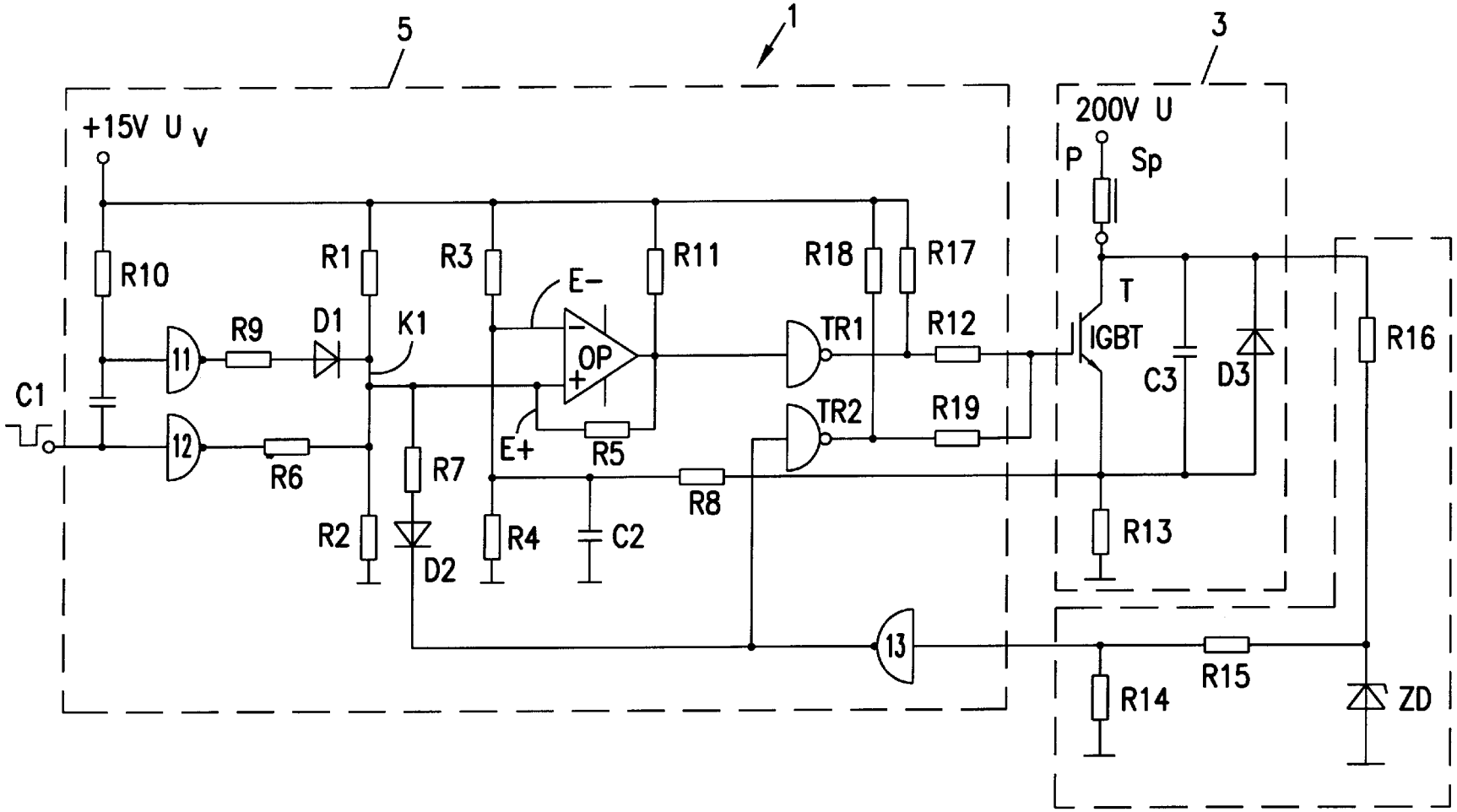
FIG. 1 shows a wiring diagram of one embodiment of the system according to the present invention.

FIG. 1 shows an a.c. ignition system 1 that includes an ignition unit 3, a control circuit 5 and a measuring device 7.

Ignition unit 3 has an ignition transistor T which is preferably designed as an IGBT (insulated gate bipolar transistor). A primary winding P of an ignition coil SP is arranged between a voltage source U and the collector of transistor T. The emitter of transistor T is grounded across a resistor R13 that serves as a current shunt. A capacitor C3 and a diode D3 polarized in the blocking direction are connected between the collector and emitter of transistor T. The base of transistor T receives an output signal from control circuit 5.

Two inverters I1 and I2 arranged parallel to each other are provided at the input of control circuit 5 and their two inputs are connected to each other across a capacitor C1. The input of one inverter I1 is also connected to a positive power supply voltage $U_v$ across a resistor R10. The input of the second inverter I2, however, serves as the input for the ignition control signal.

The output of the first inverter I1 is connected across a series connection comprising a resistor R9 and a diode D1 to a node K1 which is in turn connected to the output of inverter I2 across a resistor R6. Node K1 is connected to power supply voltage $U_v$ across a resistor R1 and to ground across a resistor R2.

Control circuit 5 also has a difference amplifier or operational amplifier OP which has two inputs $E^-$, $E^+$. Input $E^+$ is connected directly to node K1, while input $E^-$ is connected to the positive power supply voltage $U_v$ across a resistor R3. A parallel circuit comprising a resistor R4 and a capacitor C2 is provided between inputs $E^-$ and ground. Input $E^-$ of the difference amplifier is also connected to the emitter of transistor T across a resistor R8.

The output of difference amplifier OP is connected to voltage $U_v$ across a resistor R11 and to input $E^+$ across a feedback resistor R5. The output signal of difference amplifier OP is sent to a driver TR1 whose output signal is sent to the base of transistor T across a resistor R12. The output of driver TR1 itself is connected to supply voltage $U_v$ across a resistor R17.

A signal supplied by measuring device 7 is sent in control circuit 5 to a third inverter I3 whose output is connected to the cathode of a diode D2. The anode of this diode D2 is connected to node K1 across a resistor R7.

The output signal of the third inverter I3 is also sent to a driver TR2 whose output signal is sent to the base of transistor T across a resistor R19. In addition, the output of driver TR2 is connected to supply voltage $U_v$ across a resistor R18.

Measuring device 7 includes a series connection of three resistors R14 through R16, with one end of resistor R16 being connected to the collector of transistor T and one end of resistor R14 being grounded. A Zener diode is provided in parallel with both resistors R15 and R14 for protection. The measuring signal is picked up at the connecting point between the two resistors R14 and R15 and sent to the third inverter 13, as mentioned previously.

Figure 2:
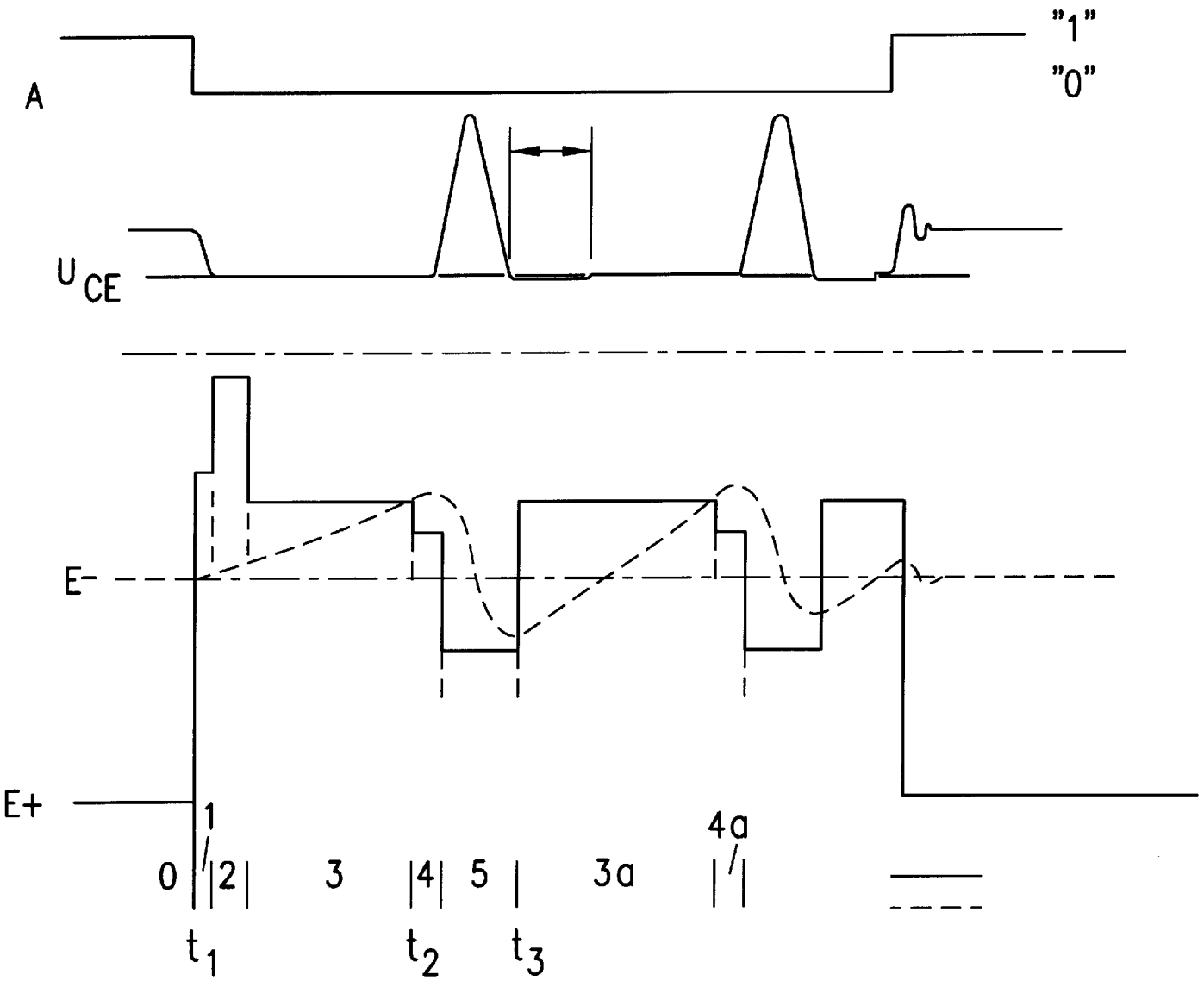
FIG. 2 shows a voltage diagram showing the signal curves of several node points of the circuit.
Figure 3:
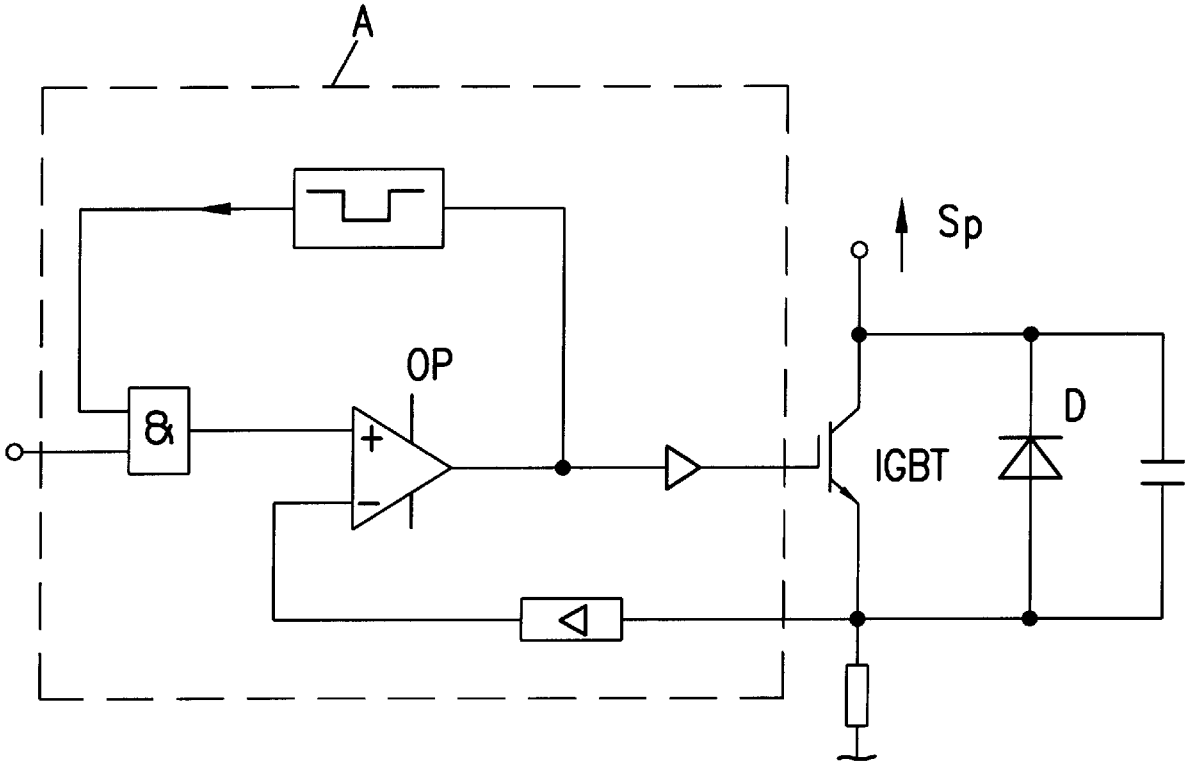
FIG. 3 PRIOR ART
FIG. 3 shows an a.c. ignition system according to the related art.

The function of the a.c. ignition circuit described here is explained below on the basis of the voltage curves according to FIG. 2.

In phase 0, where there is to be no ignition control, control signal A has a level "1" which may correspond to 15 volts, for example. The signal "1" at the input of inverter I1 and also that of inverter I2 becomes an output signal with the level "0" such as 0 volt. Thus, the potential at node K1 and accordingly at input $E^+$ of the differential amplifier is pulled to a value considerably less than the value of the potential applied at input $E^-$ due to the resistance values of resistors R1, R2, R3, R4. This is shown clearly in FIG. 2, where the solid line represents the voltage curve at input $E^+$ and the dashed line shows the voltage curve at input $E^-$.

Since input $E^-$ is at a higher potential than input $E^+$, the output of the difference amplifier has a low potential, so the control signal at the output of control circuit 5 is too low to make the transistor conducting. The transistor blocks, so the voltage which results between the collector and emitter is as shown in FIG. 2.

If the control signal is set at level "0" at time t1, the output signal of inverter I2 jumps to level "1" so the potential at node K1 also increases. At the same time, when the output signal of inverter I2 is switched, the output signal of inverter I1 is also switched to level "1" at least until capacitor C1 is charged. The "1" level of inverter I1 results in the potential at node K1 being raised further, so that it is ultimately higher than the potential of input $E^-$.

When the potential at $E^-$ is exceeded, the difference amplifier switches the output signal to level "1" with the result that driver TR1 delivers an output signal to resistor R12 and thus to the base of transistor T. Since the output of driver TR2 is switched to level "0" in this phase, R12 and R19 form a voltage divider that lowers the gate voltage of the transistor with respect to "normally on" (phase 3, 3a, . . . ), which in turn prevents a high making current of the transistor (discharging C3). The voltage between the collector and emitter then drops only slowly.

With an increase in voltage at the base of transistor T, the conductivity of the collector-emitter connection increases progressively, so the potential at the collector drops. This potential is picked up by measuring device 7 and sent to the third inverter I3 of control circuit 5. As soon as the measuring signal and thus the potential at the collector have dropped below a certain threshold, inverter 13 switches its output signal to a level "1." Thus the potential-lowering effect of resistor R7 and diode D2 is eliminated, so the potential at node K1, i.e., at input $E^+$, rises again. This can be seen clearly in phase 2 in FIG. 2. Second, level "1" across driver circuit TR2 and resistor R19 ensures that transistor T is switched through immediately.

Even at the beginning of phase 1, a current flows through transistor T, which ensures that the potential at input $E^-$ of the difference amplifier increases steadily.

As soon as capacitor C1 at the input of control circuit 5 is charged, the output signal of inverter I1 is set back to level "0" so the potential-increasing effect is eliminated. The result is a potential drop at node K1 and thus at input $E^+$, as shown in FIG. 2 at the start of phase 3. The potential at input $E^-$ increases continuously further in phase 3 due to the coil current flowing across transistor T until at time t2 it corresponds to the level at input $E^+$ which corresponds to the desired turn-off current. At the start of phase 4, potential $E^-$ exceeds the value at input $E^+$ with the result that the difference amplifier sets the output at level "0." Then the potential at input $E^+$ is reduced accordingly across feedback resistor R5, as shown in FIG. 2. However, the potential level at input $E^+$ is still higher than the level at input $E^-$ in phase 0, i.e., at a zero coil current.

During phase 4, the potential at input E increases further although transistor T is off. This is due to the fact that the coil current continues to flow after transistor T is off, due to the charging of capacitor C3.

As soon as the potential value picked up by measuring device 7 exceeds a certain threshold value, which can be adjusted through the resistances of resistors R14 through RI 6, inverter I3 switches its output signal to a level "0." As a result, the potential at node K1 is pulled down across resistor R7 and diode D2. This is shown at the start of phase 5 in FIG. 2.

In this phase 5, however, the potential level at input $E^-$ drops, yet it remains above the potential at input $E^+$. At the same time, the voltage between the collector and emitter of transistor T is a half-wave voltage, as shown in FIG. 2, with the coil current reaching its maximum negative value at the end of this half wave. At this time t3 at the end of phase 5, the voltage between the collector and emitter of transistor T has dropped only to the extent that inverter I3 sets its output signal at a level "1" so that node K1 reaches a level which it had previously in phase 3. At time t3, the level at input $E^+$ is higher than the level at input $E^-$; transistor T becomes conducting again, so that phases 3, 4, and 5 are run through again. These phases are repeated as long as control signal A is set at level "0."

It is apparent from the description of the operation that transistor T is activated only depending on the voltage variation, specifically always at the end of the half-wave of the voltage curve between the collector and emitter of transistor T. Thus, activation always occurs at the start of the time window shown in FIG. 2.

As mentioned above, the advantages can be seen in particular in the fact that the circuit is sturdy and absolutely independent of component tolerances, detuning between excitation and the natural frequency is impossible, and all the switching operations are derived from the natural frequency. Thus, power loss can be minimized, so there are no IGBT current peaks. Since the IGBT is always restarted at the beginning of the allowed time window, no particular demands are made regarding the starting characteristics of the IGBT.

What is claimed is:

1. An a.c. ignition system for an engine, the engine including an ignition coil having a primary winding, comprising:

an ignition transistor for switching the primary winding of the ignition coil, the ignition transistor having an emitter and a collector, the collector having a potential;

a control circuit for receiving a measuring signal proportional to the potential of the collector of the ignition transistor and for controlling the ignition transistor as a function of the measuring signal to activate the ignition transistor at a preselected low voltage between the collector and the emitter of the ignition transistor; and a parallel circuit coupled between the emitter and the collector of the ignition transistor, the parallel circuit including a capacitor and a diode.

2. The a.c. ignition system according to claim 1, wherein the ignition transistor switches softly when activated for a first time in each of a plurality of ignition periods.

3. The a.c. ignition system according to claim 1, wherein the control circuit includes a difference amplifier having an input for receiving the measuring signal.

4. The a.c. ignition system according to claim 3, wherein the input receives a signal corresponding to an ignition control signal.

5. The a.c. ignition system according to claim 3, wherein the input receives a voltage-increasing signal at a start of an ignition control.

6. The a.c. ignition system according to claim 3, wherein an output signal of the difference amplifier is sent to a driver circuit, and an output signal of the driver circuit is sent to a base of the ignition transistor.

7. The a.c. ignition system according to claim 3, wherein the measuring signal is sent from a voltage divider circuit to an inverter, and an output of the inverter is coupled to the input of the difference amplifier across a series connection of a resistor and another diode.

8. The a.c. ignition system according to claim 3, wherein the difference amplifier has another input coupled to the emitter of the ignition transistor.

9. The a.c. ignition system according to claim 1, further comprising a resistor serving as a current shunt arranged between the emitter of the ignition transistor and a ground.

10. The a.c. ignition system according to claim 9, further comprising another parallel circuit including another resistor and another capacitor arranged in parallel with the resistor between another input of the difference amplifier and the ground.

11. The a.c. ignition system according to claim 1, wherein an output signal of an inverter is sent to a driver circuit, and an output signal of the driver circuit is sent to a base of the ignition transistor.

12. The a.c. ignition system according to claim 1, wherein the ignition transistor is an insulated gate bipolar transistor (OGBT).

* * * * *